US009361869B2

(12) United States Patent
Rex

(10) Patent No.: US 9,361,869 B2
(45) Date of Patent: Jun. 7, 2016

(54) GENERATIVE SCHEDULING METHOD

(71) Applicant: JUKEDECK LTD., London (GB)

(72) Inventor: Edmund Rex, London (GB)

(73) Assignee: JUKEDECK LTD., London (GB)

( * ) Notice: Subject to any disclaimer, the term of this patent is extended or adjusted under 35 U.S.C. 154(b) by 0 days.

(21) Appl. No.: 14/438,721

(22) PCT Filed: Oct. 30, 2013

(86) PCT No.: PCT/GB2013/052831

§ 371 (c)(1),
(2) Date: Apr. 27, 2015

(87) PCT Pub. No.: WO2014/068309

PCT Pub. Date: May 8, 2014

(65) Prior Publication Data

US 2015/0255052 A1 Sep. 10, 2015

(30) Foreign Application Priority Data

Oct. 30, 2012 (GB) ..... 1219521.0

(51) Int. Cl.

| | |
|---|---|
| ***G10H 1/36*** | (2006.01) |
| ***G10H 7/00*** | (2006.01) |
| ***G10H 1/00*** | (2006.01) |
| ***G10H 1/40*** | (2006.01) |

(52) U.S. Cl.

CPC ..... *G10H 1/0066* (2013.01); *G10H 1/0025* (2013.01); *G10H 1/40* (2013.01); *G10H 2210/121* (2013.01); *G10H 2210/131* (2013.01); *G10H 2250/015* (2013.01)

(58) Field of Classification Search

CPC ..... G10H 1/0066; G10H 1/0025; G10H 2210/121; G10H 2210/131

USPC ..... 84/634

See application file for complete search history.

(56) References Cited

U.S. PATENT DOCUMENTS

| | | | | |
|---|---|---|---|---|
| 6,313,390 | B1 * | 11/2001 | Adriaans et al. | 84/645 |
| 7,777,123 | B2 * | 8/2010 | Hennig et al. | 84/609 |
| 2007/0074620 | A1 * | 4/2007 | Kay | 84/619 |
| 2011/0010321 | A1 * | 1/2011 | Pachet et al. | 706/12 |
| 2015/0255052 | A1 | 9/2015 | Rex | |

FOREIGN PATENT DOCUMENTS

FR 2 903 803 A1 1/2008

OTHER PUBLICATIONS

The International Bureau of WIPO, "Search Report" in application No. PCT/GB2013/052831, dated Feb. 24, 2014, 12 pages.

Redeout, E., "Sibelius 1.0," Keyboard, Us, Miller Freeman Publications, San Francisco, CA; vol. 25, No. 4, Apr. 1999; pp. 108-110,112,114, XP000823548; ISSN: 0730-0158.

Inernational Searching Authority, "Written Opinion" in application No. PCT/GB2013/052831, dated Feb. 24, 2014, 7 pages.

* cited by examiner

*Primary Examiner* — Jeffrey Donels

(74) *Attorney, Agent, or Firm* — Hickman Palermo Becker Bingham LLP

(57) ABSTRACT

A method for providing one or more outputs at one or more respective time instants is provided. The method comprises generating a data object executable to provide an output, placing the object in a position in a sequence, and executing the object at said position in said sequence to provide said output. Each position in the sequence represents a time instant.

22 Claims, 15 Drawing Sheets

| Duration of previous note | Duration of next note | | | | | | | |
|---|---|---|---|---|---|---|---|---|
| | 0.5 | 1 | 1.5 | 2 | 2.5 | 3 | 3.5 | 4 |
| 0.5 | p | p | p | p | p | p | p | p |
| 1 | p | p | p | p | p | p | p | p |
| 1.5 | p | p | p | p | p | p | p | p |
| 2 | p | p | p | p | p | p | p | p |
| 2.5 | p | p | p | p | p | p | p | p |
| 3 | p | p | p | p | p | p | p | p |
| 3.5 | p | p | p | p | p | p | p | p |
| 4 | p | p | p | p | p | p | p | p |

Fig. 6

Pitch of cadence note

| 0 | 1 | 2 | 3 | 4 | 5 | 6 |
|---|---|---|---|---|---|---|
| p | p | p | p | p | p | p |

Fig. 8

GENERATIVE SCHEDULING METHOD

FIELD

The invention relates to a method for generating data objects for execution in a sequence. In an embodiment, the invention relates to a generative music method.

BACKGROUND

Previous attempts at generative music software have generally fallen into two categories: those whose output is overwhelmingly random, because they do not apply the rules and constraints to the random output that are necessary to produce the kind of structured music that 'makes sense' to the listener's ear; and those that use machine-learning to build up a database of the likely patterns and progressions in a certain style of music, in order to imitate that style.

SUMMARY

An invention is set out in the claims.

BRIEF DESCRIPTION OF THE DRAWINGS

Embodiments of the invention will now be described, by way of example, with reference to the drawings, of which:

FIG. 6 shows a representation of a probability array in the form of a multi-dimensional vector;

FIG. 8 shows a representation of a probability array in the form of a single-dimensional vector;

OVERVIEW

A method for providing a plurality of outputs at respective beats is provided. The method combines a random number generator with a set of rules and algorithmic processes that are applied to the random output to generate in real time or as a batch a coherent sequence of data objects executable in sequence to provide an output at beats corresponding to the sequence position.

DETAILED DESCRIPTION

Throughout the following, the term "array" may be used interchangeably with "matrix", "vector", or any other sequence of values or continuous function. Whenever the use of a random number generator and a probability array is described, it is referring to a process in which a random number is generated and used to select an entry in a probability array, as described in more detail below.

In overview, referring to flow diagram 100 data objects are generated and stored in a list for sequential execution. The data objects may represent audio data, for example. In particular, the audio data may represent musical notes. Thus the list may be referred to as a list of notes. When a data object is executed, musical note data is appended to a list or file, which may be a list of musical note data scheduled for playback through an output, or a data file used for storage and future playback. This data file may be a text file, a MIDI data file, an audio data file, or any other type of data file. The list or file of musical note data may be played directly on an output device or sent to a remote output device on which it can be played. For example musical note data may be streamed over the internet to a remote device, and the remote device may use the musical note data to assemble an audio file or other playback mechanism and play the resulting music.

The method executes the data objects in the list sequentially, with each data object ascribed an instant in time on which it should be played. Because the list of notes is appended to a data file, or played, sequentially, the position of a note in the list determines the instant in time ascribed to that note on which it will be played without requiring the time to be explicitly specified, as this is determined by the ordering. The method 100 therefore schedules a data object for execution by placing the object at a particular position in the list, corresponding to an instant on which the note represented by the data object is to be played. In musical terms, each position in the list represents a beat.

Figure 1:
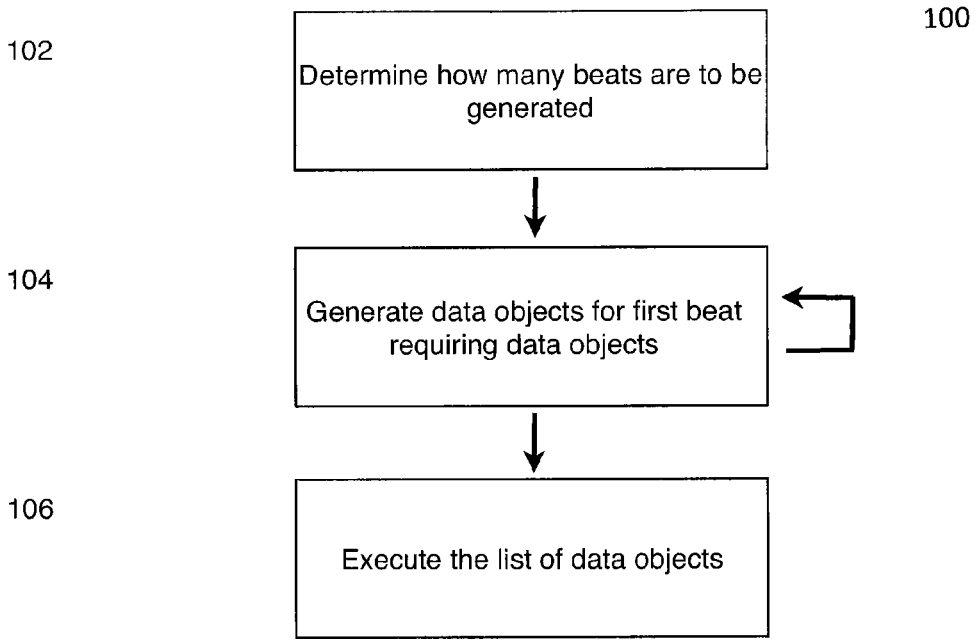
FIG. 1 shows a flow diagram of a method for generating and executing data objects.

With reference to FIG. 1, in operation the method 100 determines how many beats require data objects to be generated at step 102. At step 104, if there are any beats requiring data objects, new data objects are generated for the first such beat requiring data objects. The method 100 keeps returning to step 104 to generate more data objects until there are no more beats requiring data objects. When there are no more beats requiring data objects, the list of data objects is executed at step 106.

The number of beats that require data objects to be generated is determined at step 102. This may be all the beats in the total duration of the music, which we will call batch generation. Alternatively, it may be any number of beats that does not represent all the beats in the total duration of the music. If this is the case, the method 100 may be run during playback of the data objects, whenever there are only a small number of generated data objects yet to be played, so that data objects are only generated just before they are to be played; we will call this realtime generation. Alternatively, the method 100 may be repeatedly run during or before playback of the data objects, in order to prepare as quickly as possible the first data objects to be played and be able to play them while more data objects are being generated; we will call this continuous generation. In another embodiment, it may be determined at step 102 that no number of beats should be set and that data objects should continue to be generated indefinitely until either a random number generator coupled with a probability array determines that the music should end or an input such as a user input or another input described in more detail below signals that the music should end.

The number of beats that require data objects to be generated may be set by the user. Alternatively, it can be set using a random number generator coupled with a probability array, or according to the total duration of the music. The total duration of the music, similarly, is determined using a random number generator coupled with a probability array. Alternatively, the total duration may be set by a user or by some other input, described below.

Figure 2:
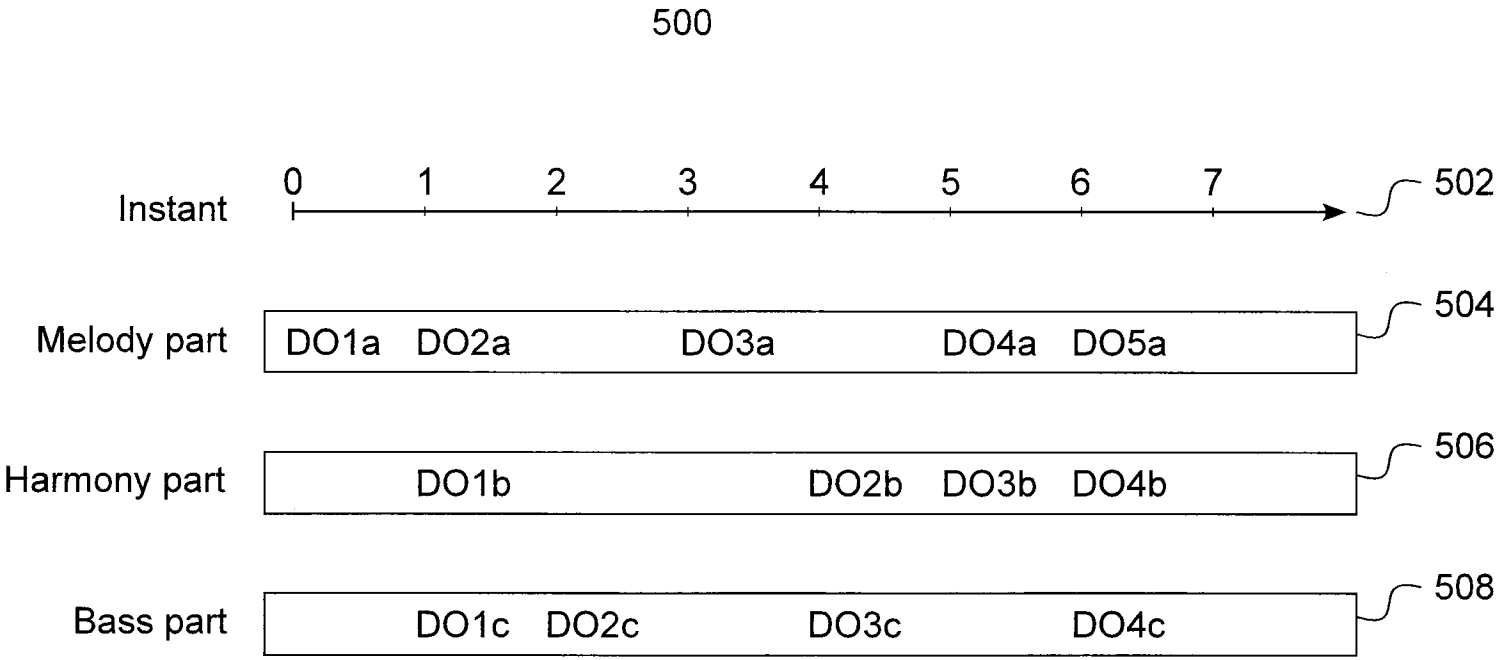
FIG. 2 shows a list of data objects comprising a number of parts.

The list of data objects may comprise a number of lists each representing a different part, for example a melody part, a bass part, a harmony part or other type of part. Within each list of data objects, it is not necessary that every instant be assigned a data object; a data object may last for more than one instant, in which case there will be no data objects after the data object at the further instants in the list that the data object covers. A null value such as a rest may indicate that no output is to be generated for one or more instants. At step 106, new data objects are generated for each part that requires more notes. The exact make-up of parts may vary with each running of the method 100, and may also vary within a single running of the method 100. An example of a list of data objects 500 comprising a number of parts is shown in FIG. 2. The list 500 comprises a melody part 504, a harmony part 506 and a bass part 508. Each part comprises a number of data objects DO1*a* to DO5*a*, DO1*b* to DO4*b* and DO1*c* to DO4*c*, each ascribed to a respective instant 502. For example, the melody part 504 comprises data objects DO1*a*, DO2*a*, DO3*a*, DO4*a* and DO5*a* ascribed to instants 0, 1, 3, 5 and 6, respectively. Alternatively, each part may contain its own list of data objects.

Step 104 of the method 100 may be repeated as described above and may be referred to as the generator loop. The generator loop until data objects have been generated for all the beats the method 100 is generating data objects for.

During each cycle of the generator loop, new data objects are generated for the first beat that requires data objects and hasn't yet had data objects generated.

A data object's position in the list of data objects is used to ascribe an instant on which that data object should be played. When a data object is generated, it is ascribed an instant for playback by adding the data object to an ordered list at a position corresponding to the beat number on which the data object should be played. The list of data objects in method 100 maintains the current beat number.

Alternatively, the data objects could each store a scheduled beat number corresponding to the beat on which they are scheduled to be executed. The data objects could then be stored in an unordered list. On execution of the list, step 106 of the method 100 searches through the list and executes the data objects in order of increasing beat number.

Before any data objects are generated in list of data objects, a setup routine may be run. Empty lists for storing the data objects of each part, different types of data object (for example notes, chords and phrases), and probability arrays used in the generation of data objects are initialised. These items may be initialised in a variety of different ways, for example by using a random number generator coupled with probability arrays, by importing values from a stored settings file, by taking values from a user's input or some other input described below, or by a combination of the three methods. Similar methods are used to select musical factors such as key, tempo, time signature and the number and composition of parts. This setup routine is run before the first time method 100 is run, but it need not be run for further calls of method 100 within the same musical piece, since these calls can use the same lists and probability arrays that were set up at the start of the musical piece.

The generation of data objects will now be described in more detail. Whenever a data object is generated, various checks are performed against data objects scheduled for simultaneous instants in time or on adjacent or nearby beats in the same part as the data object being generated or in other parts. Each check increases or decreases the probability, drawn from the probability arrays initialised during the setup routine described above, of a specific value being selected for a particular variable of the data object being generated. Once all checks have been run, the values of the various variables of the data object being generated are selected using a random number generator coupled with the probability arrays that have arisen from the checks.

The checks used in the generation of data objects include consonance checks, which will be described in more detail below. In addition to consonance checks, other checks may be performed whenever a data object is generated. For example, the method may check that the pitch of the data object being generated falls within a particular range. Additionally or alternatively, the method may check that an interval between the pitch of the data object being generated and the pitch of a preceding data object falls within a pre-defined set of allowed intervals.

Other factors are considered when generating data objects through the use of probability arrays determining intervals and chord progressions that are likely to follow previous melodic and harmonic movement, probability arrays determining durations that are likely to follow previous rhythmic movement, probability arrays determining whether phrases and sections should come to an end, and probability arrays determining what happens if it is decided that a phrase or section will come to an end. Probability arrays will be described in more detail below.

Data objects may be generated as free data objects. A free data object may be generated independently of other data objects, or it may be generated taking surrounding data objects into consideration. It may be generated by using a random number generator combined with a probability array initialised during the set-up routine described above, or by using the checks described above, or by using a combination of these two methods.

A number of data objects may be generated as part of a pattern or group based on a certain sequence of data objects that has already been generated. The certain sequence of data objects can be a sequence of data objects generated earlier on in the music that has been stored in the list of notes. By generating patterns of data objects based on previous sequences of data objects, musically coherent sequences of data objects can be generated.

The pattern of data objects may be a repeat of the certain sequence of data objects, in which case the certain sequence of data objects is copied to a position in the list corresponding to the beat on which the certain sequence should be repeated. Alternatively, a transformation may be applied to the certain sequence to generate the pattern. Any suitable transformation may be used, for example a transposition (a shift in the pitch of the notes), an inversion (an inversion of the intervals between the notes), a retrograde (a reversal of the order of the notes), a rhythmic alteration or other transformations and processes.

Figure 3:
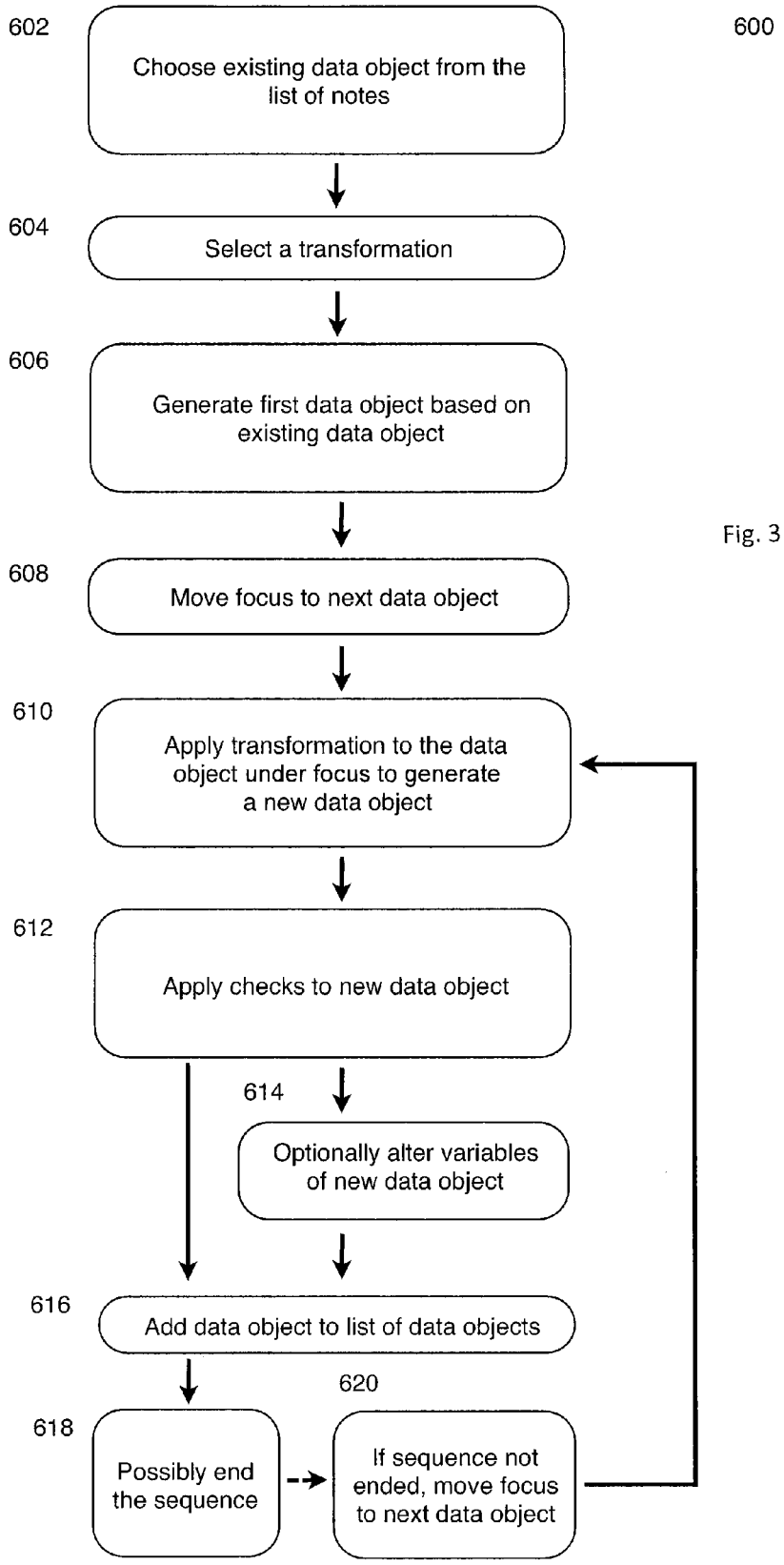
FIG. 3 shows a flow diagram of a method for constructing patterns.

To ensure both that sensible patterns are constructed and that there is a great deal of variation in the way patterns are constructed, the following mechanism is employed. With reference to the method 600 of FIG. 3, a data object on which the first note of the pattern will be based is selected at step 602 from the list of notes using a random number generator and a probability array, which for example could allow a selection based on factors such as the number of beats between the start of the pattern and the data object in question. For the purposes of this description, we will call the data object on which we are basing the note of the pattern currently being generated the 'note of focus'.

Once the initial note of focus has been chosen, a transformation is selected at step 604. The transformation may be any of the transformations mentioned above, or any other suitable transformation. The first note of the pattern is then generated using all, some or none of the elements of the note of focus, at step 606. The number and types of elements of the note of focus that are re-used for the new data object is decided by a random number generator and probability array. In order to start generating the second note of the pattern, a note adjacent to the note of focus (the next or the previous note depending on whether the selected transformation involves maintaining or reversing the order of the original data objects, respectively) is selected from the list of notes and becomes the note of focus at step 608, so that there is a new note of focus on which the second note of the pattern can be based.

The selected transformation is then applied to the note of focus at step 610, generating a new data object. The various data object-generation checks described above are applied to this data object at step 612. If the application of these checks renders a data object impossible, or if a random number generator and probability array dictates that this course should otherwise be taken, any number of the elements or variables of the new data object may be altered at step 614. The variables contained within data objects will be described in more detail below. The data object is then added to the list of data objects at step 616, and the sequence may come to an end at step 618, as determined by a random number generator and probability array. If the sequence does not come to an end, the note of focus again shifts either forwards or backwards (according to the type of transformation) in the list of notes at step 620, and the method 600 returns to step 610 to generate another note of the pattern.

Figure 4:
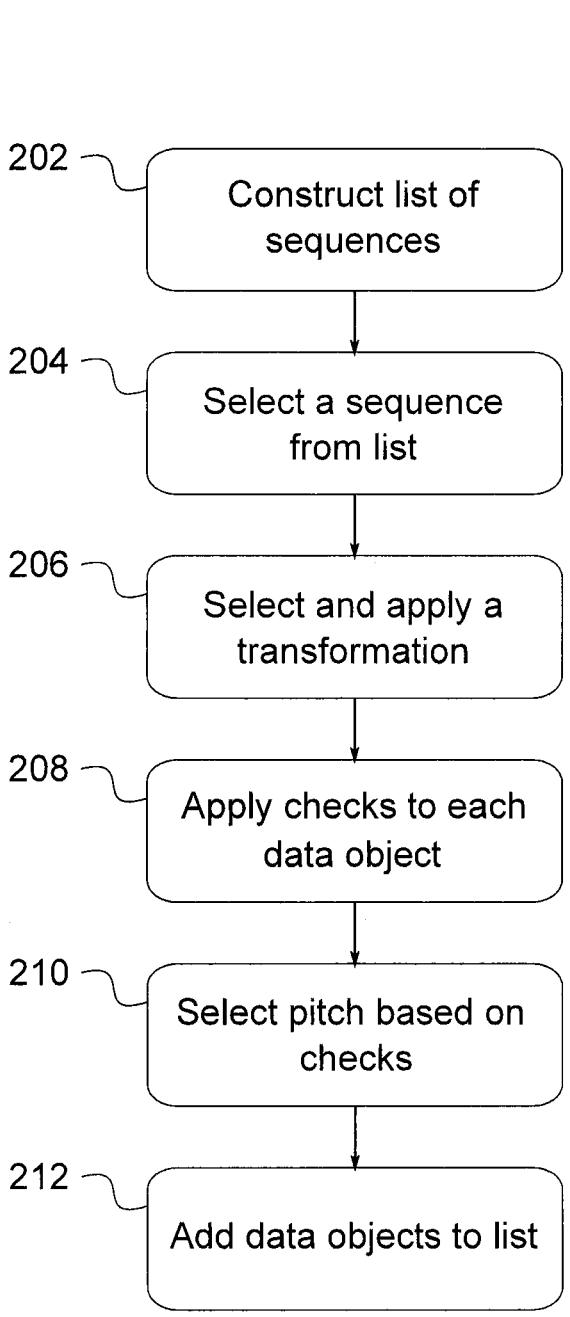
FIG. 4 shows a flow diagram of another method for generating data objects.

In an alternative embodiment for generating a pattern of data objects, with reference to the method 200 of FIG. 4, a list of possible sequences of data objects on which the pattern is to be based is drawn up at step 202. One of these sequences of data objects is selected at step 204 using a random number generator and a probability array.

Once the sequence of data objects on which the pattern is to be based has been chosen, the pattern is generated by applying a transformation to the sequence at step 206. The various data object-generation checks described above are then applied to each data object in the pattern at step 208. These checks are repeated at various different shifts in pitch of the entire pattern. At step 210 a particular pitch shift is selected based on the outcome of the checks. The selected shift of pitch is applied to each of the data objects in the pattern and then the data objects are added to the list of data objects at step 212.

In each of the above pattern generation methods, as each new data object is generated, consonance checks and other checks are performed. If the new data object does not satisfy these checks, one or more of the parameters (or elements or variables) of the new data object may be varied until the new data object does satisfy these checks. Alternatively, the pattern may come to an end. A variation or an end to the pattern may also occur if the checks are satisfied but a random number generator and probability array determines that one of these options should be taken.

When either a free data object or a pattern is being generated in a given part, the other parts may be in one of three states. Firstly, a second part may already have had data objects generated for the beats for which data objects are being generated in the first part, in which case the data objects in the second part can be used for consonance checks and other checks during the generation of data objects in the first part. Secondly, a second part may have no data objects yet generated for the beats in question, in which case the data objects can be generated in the first part without recourse to this second part. Or thirdly, a second part may be having notes generated alongside the generation of the data objects in the first part, in which case the generation of data objects alternates between the parts, and for each data object that is generated one of the first two states described above is found in the other generating part.

Whether the method generates a free data object or a pattern of data objects, which certain sequence of data objects the pattern is based on, and whether the pattern constitutes a repeat or some other transformation of the certain sequence is decided in real time as the data objects are generated using a random number generator coupled with probability arrays.

Figure 5:
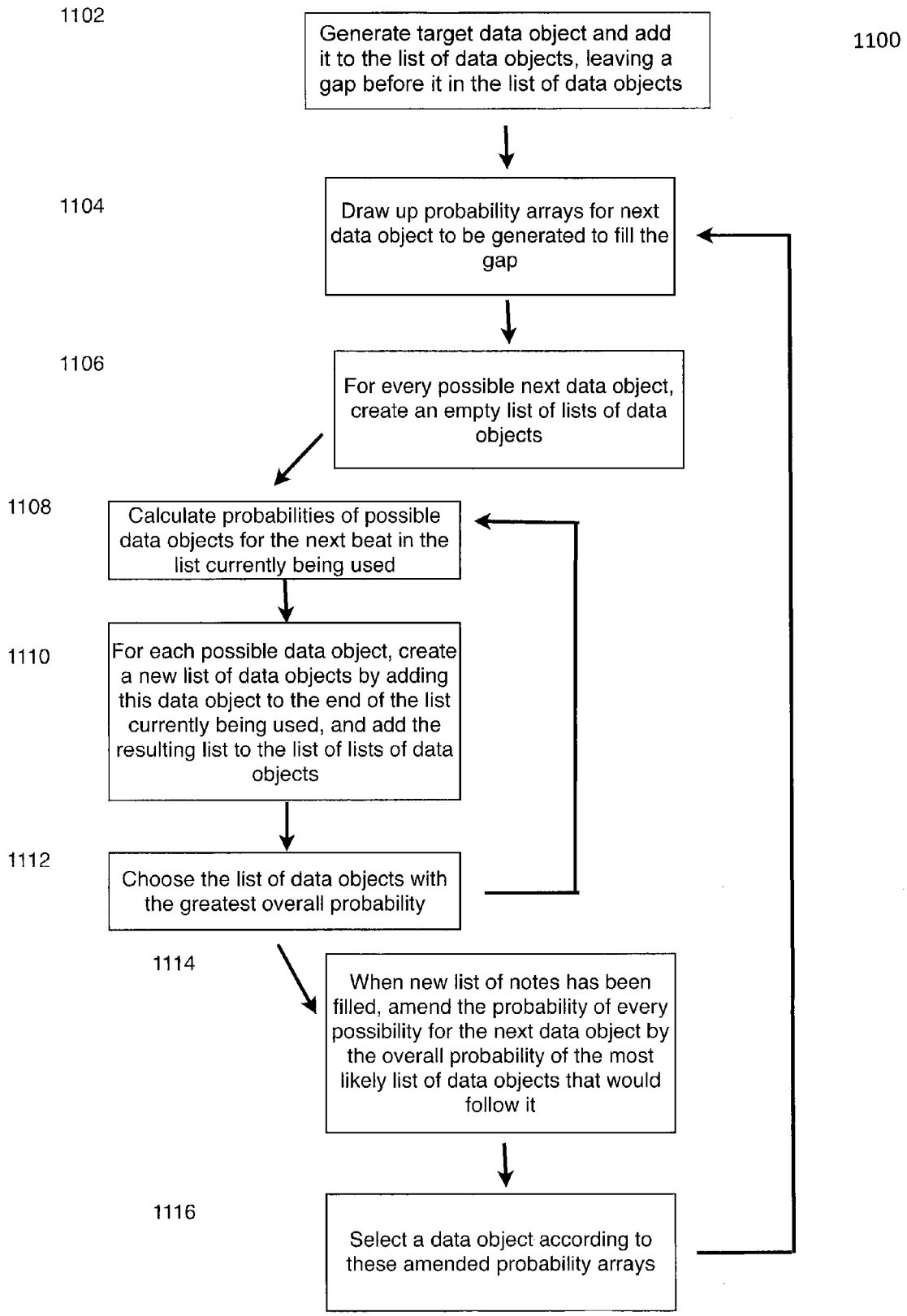
FIG. 5 shows a flow diagram of a method of generating data objects a number of beats in advance of a target data object.

In order to generate music that has a sense of direction, the method 1100 of FIG. 5 can generate a data object a number of beats in advance, leaving a gap in the list of data objects before the generated data object that needs to be filled, and then fill that gap with data objects that work towards the data object generated in advance. We can call the data object generated in advance a target. Working towards targets in this manner presents a technical challenge. At step 1102 a target data object is generated and added to the list of data objects, leaving a gap in the list of data objects before the target that needs to be filled. Probability arrays for the first data object to fill the gap are then drawn up at step 1104 in the usual manner, described above. However, the overall probability of the most likely sequence of data objects that would fill the remaining gap between the data object being considered and the target data object is calculated for each possible data object for the beat being generated in steps 1106, 1108 1110 and 1112, and the probability of each possible data object for the beat being generated is altered according to that probability at step 1114. Once all probabilities have been altered in this way, a data object is selected at step 1116. The method repeats steps 1104, 1106, 1108, 1110, 1112, 1114 and 1116 until the gap has been filled and the target data object has been reached.

The overall probability of the most likely sequence of data objects that would fill the remaining gap between a data object being considered and the target data object may be calculated in the following manner. An empty list of lists of data objects is created at step 1106. The probabilities of the various possible data objects for the first beat of the gap are calculated at step 1108 using the usual data object generation methods involving probability arrays, as described above. Each of these possible data objects is entered into the list of lists of data objects as a new list of data objects at step 1110. The list of data objects with the greatest overall probability is selected at step 1112, and this list of data objects is used to continue. Steps 1108, 1110 and 1112 are repeated until the most probable sequence of data objects that could fill the gap has been calculated; at every stage, the list of data objects with the greatest overall probability is selected at step 1112, the probabilities of the various possible data objects that can follow it are calculated at step 1108, and a new list of data objects is created for every possible ensuing data object by adding it to the list currently being used, with all these lists being added to the list of lists of data objects, at step 1110.

When the most probable sequence of data objects that could fill the gap has been calculated, the list of data objects with the greatest overall probability is selected at step 1112.

In an alternative embodiment, the overall probability of the most likely sequence of data objects that would fill the remaining gap between a data object being considered and a target data object may be substituted for an approximation of this value. This approximation may be reached by limiting the number of possible data objects considered at every stage to a certain number of the most probable data objects. Alternatively, it may be reached by using some heuristic, such as the number of semitones between the musical pitches of the two data objects or the number of steps around the circle of fifths between the musical pitches of the two data objects. Such an approximation leads to faster data object generation, which is useful when trying to maximise speed in realtime generation and other forms of generation.

The method can structure the music into phrases by generating data objects to form a cadence at the end of each phrase. The degree to which the music is structured into phrases depends on how often the method generates a cadence sequence, which is determined during the setup routine described above and can be altered during the method 100 through the use of a random number generator and a probability array. Different rules and probability arrays determine the generation of data objects for a cadence and govern the beat on which the final notes of a phrase will be played, the pitches those final notes will take, and other factors.

The beats on which each phrase begins and ends are stored so that the entire phrase, or a section of a phrase, can be recovered and repeated or used in the generation of a pattern of data objects as described above.

The use of probability arrays described herein allows certain progressions in the music to be more likely than others, while leaving enough of a random element so that the music is different every time the method is run. For example, a probability array can represent the likelihood of various different note durations for the next data object given the note duration of the preceding data object.

Such a probability array is shown in FIG. 6. Each p in FIG. 6 represents an individual probability; each of these probabilities may either be different from the other probabilities in the array or be equal to some or all of the other probabilities in the array. Each row of probabilities p in FIG. 6 represents a set of probabilities to be used given a particular duration of the note of the preceding data object. Each column of probabilities in FIG. 6 represents a set of probabilities that a particular duration will be selected for the note of the data object being generated.

To give an example, a probability array may represent four different outcomes: A, B, C and D. If each of the four outcomes is equally likely, the probability array may be represented as (0.25, 0.5, 0.75, 1). To select an outcome, a random number between 0 and 1 is generated. The random number is compared with each value in the probability array, from left to right in this example, and the outcome corresponding to the first value that is greater than the random number is selected. For example, if the random number generated is 0.85, outcome D is selected. A probability array therefore represents a weighting associated with various outcomes.

To determine the duration of the note of the data object being generated, a row of the probability array is selected based on the duration of the note of the preceding data object. For example, if the duration of the preceding note was 2, the fourth row is selected. The selected row of the probability array represents the various likelihoods of the different possible durations for the next note. A particular duration is selected for the data object being generated by coupling the selected row with a random number generator as described above.

Figure 7:
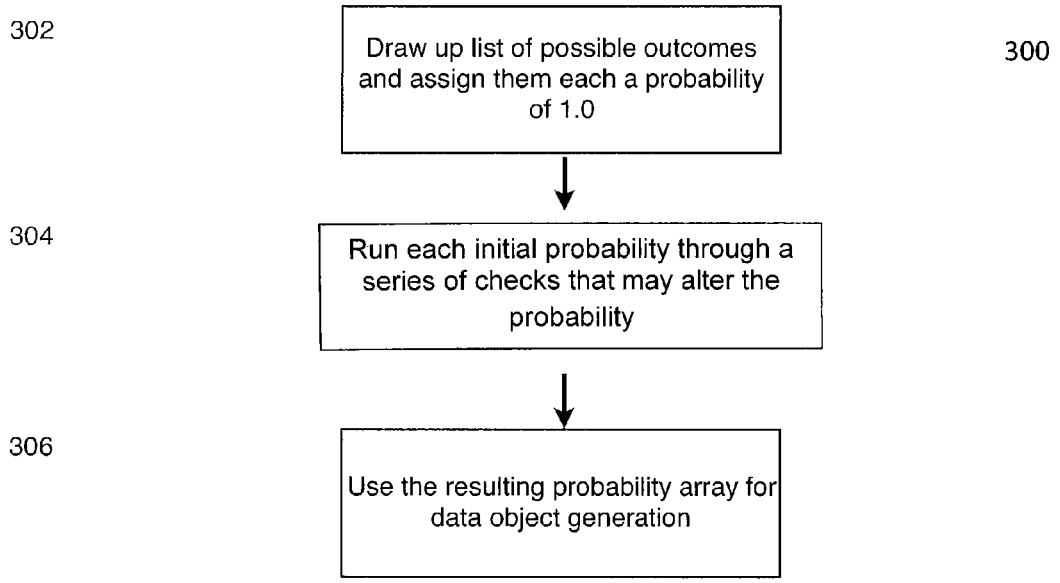
FIG. 7 shows a flow diagram of a method of building a probability array during the generation loop.

Probability arrays can be imported from a configuration file or they can be built during the generation loop at step 104 of method 100. A method 300 will now be described, in relation to FIG. 7, for building a probability array during the generation loop. At step 302 a list of possible outcomes is drawn up, with every outcome initially assigned a probability of 1.0. Then, at step 304, the initial probability for each possible outcome is run through a series of checks that increase or decrease the probability according to consonance and other checks, detailed above. At step 306, once every possibility has had its probability run through all the required checks, the probability array is ready to be used as detailed above.

The same process can be used in many different contexts herein and wherever the use of probability arrays is mentioned. For example, probability arrays can be used to select the pitch of the next note based on a pitch, duration or other parameter of a preceding note; to select the transformation to be applied to the next pattern based on a transformation applied to a previous pattern; to determine whether to instigate a cadence based on the number of beats since the last cadence; to determine the types of parts used and the relationship between them (that is, for example, which parts are checked for consonance against which other parts); and to make many more determinations.

FIG. 6 represents a probability array that takes the form of a multidimensional vector; however, probability arrays may also take the form of single-dimensional vectors, as in FIG. 8, and they may be stored in other forms, such as arrays, lists, matrices, and others not here mentioned.

Each data object represents a note in the music. Each data object contains variables corresponding to the pitch, duration and volume of the note, as well as information about on which instrument the note should be played, and other factors. A data object may represent, inter alia, a single note, a collection of several notes (a chord), a pitched or unpitched percussive sound, a duration having no pitch (a rest), a mode or scale of notes representing the harmony on that beat, or some other pre-recorded sound.

Once a data object has been generated, it is stored in an expanding list of data objects. The list of data objects stores the data objects in an order corresponding to the beats on which the data objects will be played. Each data object remains in the list of data objects until all data objects have been generated, so that it can be used to generate patterns and other sequences of data objects as described above. Once the list of data objects is complete, each data object may be executed. This may involve immediately converting the list to audio and playing it back on an output device, or storing it as text, audio or other data for future playback or for combination with some other media, for instance a video or a game. Once the data objects have been executed, the list of notes may be cleared.

At any point during or after the generation of data objects, the list of data objects can be regenerated from a certain point in the list of data objects onwards. Alternatively, a specific section of the list of data objects can be regenerated. This presents a technical challenge, since the state of the generation parameters as they were when the data objects in the list at the point to be regenerated were originally generated must be recreated. This is achieved by storing the state of the generation parameters on every beat in the list of data objects, so that that state can be returned to in order to regenerate data objects. This method enables users to edit certain data objects or sections of the list of data objects after the generation of data objects is complete.

The consonance checks mentioned above will now be described in more detail. Consonance is, essentially, the degree to which notes fit together, given their fundamental frequencies and harmonics. The more two notes sound like they go together, in general, the greater the consonance between them. This principle applies both to data objects scheduled for simultaneous instants in time and to data objects scheduled for sequential instants in time. Generating data objects with a high level of consonance presents a technical challenge. To achieve a high level of consonance, a number of intervals are defined. For each interval, a probability is defined that represents the likelihood of two simultaneous data objects having that interval appearing in the music. The intervals and their respective consonance probabilities may be either stored in a settings file that is read during the setup routine described above, generated using a random number generator and probability arrays, or generated using a combination of these two methods.

When a data object is generated, its pitch is chosen according, inter alia, to how consonant it is with the pitches of other data objects that are scheduled for the same instant in time as the data object being generated, or that are scheduled for an instant in time that is soon before the data object being generated and whose output will be ongoing at the scheduled instant in time of the data object being generated. The consonance of a potential pitch for a data object being generated is checked by calculating an interval between the potential pitch and the pitch of one or more other data objects that are scheduled at simultaneous instants in time or whose output will be ongoing at the scheduled instant in time of the data object being generated, and selecting the potential pitch for the data object being generated according to the outcome of a random number generator coupled with the defined consonance probability for that interval.

Other rules may also be applied: for example, a dissonant note (that is, a note that is not consonant) may require an adjacent consonant note to follow it; or a consonant note may be allowed to extend past the end of a note in another part, but a dissonant note may not be allowed to do so. A consonance check may also involve checking surrounding data objects, and evaluating potential data objects that could follow the data object being generated.

Instead of scheduling data objects to be played on a particular beat by arranging the data objects in a list, the method can allow for notes to be scheduled between beats by scheduling the data objects to be played at a specific time. In this embodiment, data objects are ascribed playback instants at scheduled times instead of on a particular beat. In an alternative embodiment, data objects can be ascribed playback instants both on particular beats and at specific times that fall between beats (by being scheduled at times relative to beats; for example, a data object may be ascribed a playback instant a certain number of milliseconds after a certain beat).

The execution of a data object may cause a sound from a library of pre-recorded sounds to be played. Alternatively, when a data object is executed the waveform of the sound may be generated by the application and then played. In an embodiment, instead of or in addition to playing a sound, audio data representing the sound may be appended to an audio file when a data object is executed. The audio file may then be retrieved and played back or downloaded at a later time.

Similarly, non-audio data may be appended to a file when a data object is executed, and thus stored for later retrieval, execution and playback, so that a user may recall a particular piece of music generated by the method; the stored data can be used by the method to create new data objects to be executed (or, if the data objects themselves are stored, they can simply be executed themselves).

The various parameters used in the setup routine and when generating data objects may be modified in response to feedback received from the user. The feedback may be received through buttons on the user interface, deduced from the types of music the user chooses to keep listening to and the types of music the user chooses to skip, deduced from the types of music the user chooses to listen to at various times of day or in various situations, or received by any other suitable method.

The various parameters used in the setup routine and when generating data objects may also be modified in response to various other inputs. For example, the user may be able to choose a style of music, the tempo, etc. through a user interface. The method may also adjust those parameters in response to data received from a sensor of a device, for example an accelerometer or a microphone, or in response to other factors, such as information obtained from the internet about the current weather, location or time of day, or information about any media the music is intended to accompany, such as the duration of a video.

Data received from the various sources identified above can be used to affect both overall settings, such as genre and tempo, and the probability arrays used in the generation of data objects that determine the course the music takes. For example, if a user is running while listening to music, the method can detect the regular motion that arises from the running and adjust the tempo of the music to align with the period of that motion. Similarly, data received indicating that it is raining can be used to adjust the probability arrays such that the music is more likely to tend towards a minor key.

Figure 9:
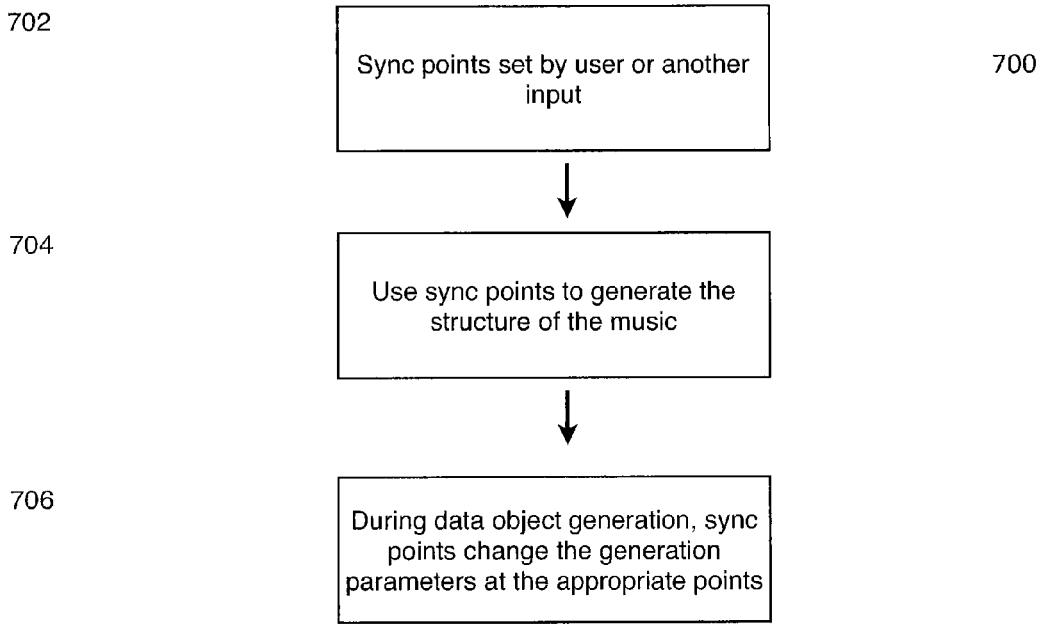
FIG. 9 shows a flow diagram of a method of generating data objects using sync points.

A method 700 by which data received from various sources can be used to affect the generation of data objects will now be described in more detail in relation to FIG. 9. Specific instants in time may be specified as points at which the parameters affecting the generation of data objects should be altered, which we can call sync points. Making these sync points affect the generation of data objects in the desired manner at the desired time presents a technical challenge. The sync points may be set before the generation of data objects begins. At step 702 these sync points are set, including data that dictates the instant in time they relate to and what should happen to the generation parameters at that instant. These sync points may be set by a user, or they may be set according to some other input such as video analysis software that scans a video for changes of scene and sets sync points at those changes.

At step 704 the sync points are used to generate the structure of the music. The specific instants ascribed to the sync points are used to determine possible numbers of beats, speeds, time signatures, and other factors that can be selected for the data objects between the sync points. The total duration of the music, as well as probability arrays as described above, may be used in conjunction with the sync points to determine this structure. For instance, if two sync points are placed 3.4 seconds apart from each other, a probability array may dictate that 64 beats must fall between those sync points, which in turn would dictate that the speed of the music must be 0.053125 seconds per beat.

Then, during the generation of data objects, when data objects are generated in the time region of a sync point, that sync point is used at step 706 to change the generation parameters, for instance by altering the speed of the music or the instruments being used.

In an alternative embodiment, a sync point can be set during the generation of data objects, either for some future instant in time or for the instant that has been reached in the generation. In this case, an input may immediately have an effect on the generation parameters, meaning that the music responds to external inputs as it is generated or played.

Figure 10:
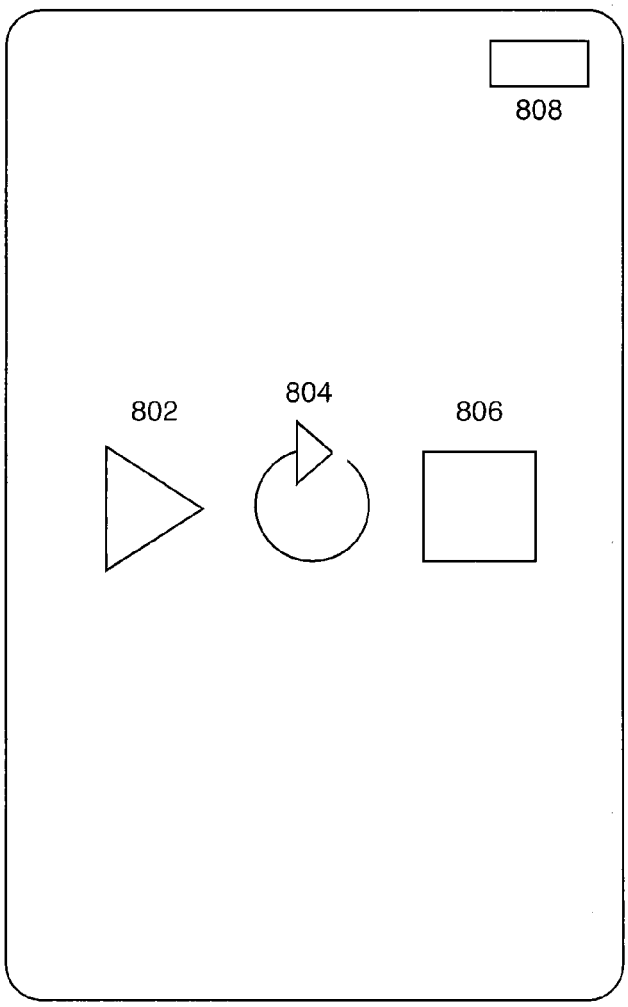
FIG. 10 shows a schematic diagram of a main screen on the User Interface.
Figure 11:
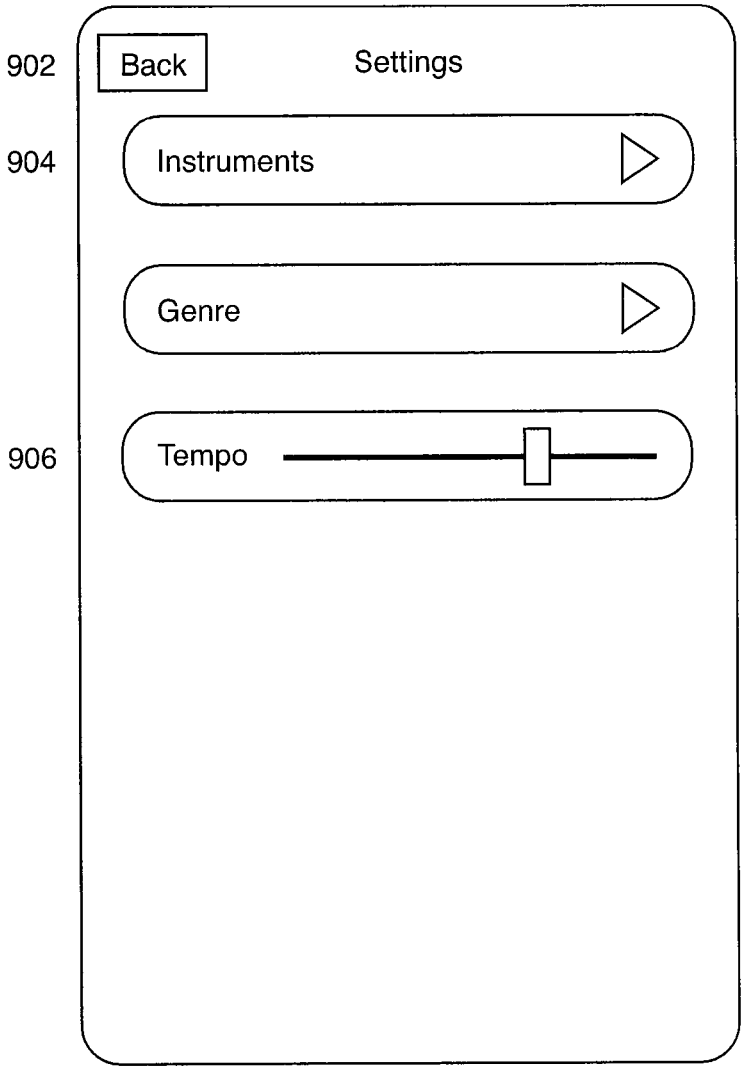
FIG. 11 shows a schematic diagram of a settings screen on the User Interface.
Figure 12:
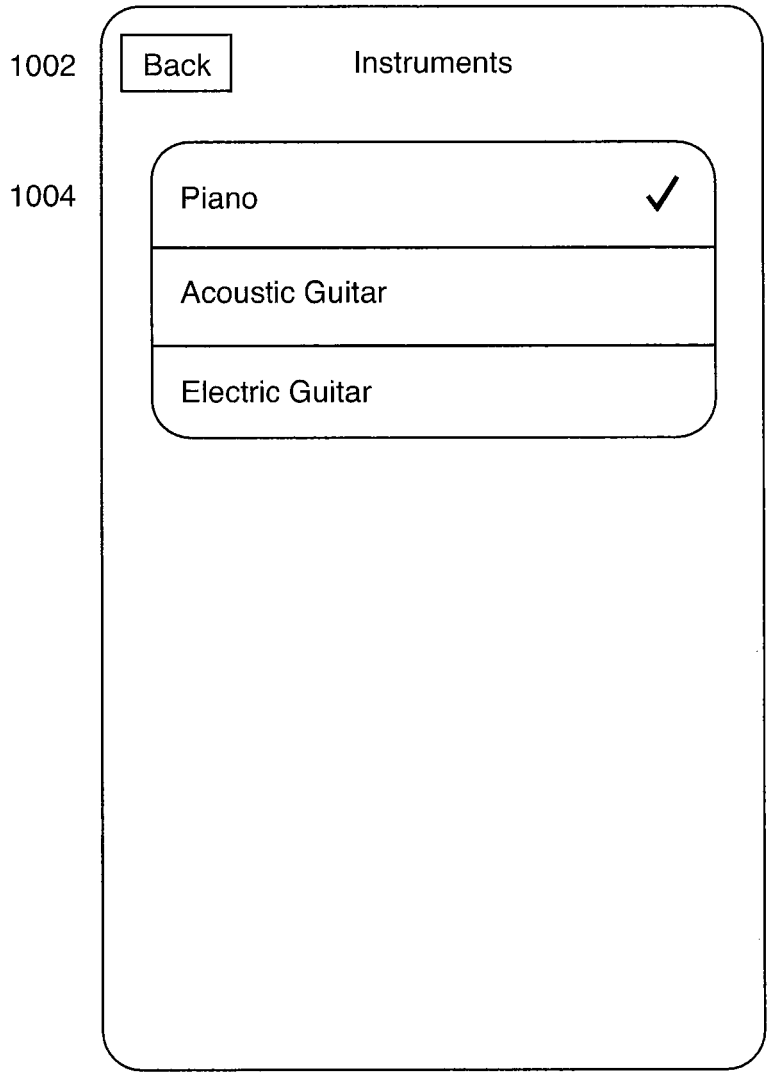
FIG. 12 shows a schematic diagram of a further settings screen on the User Interface.

A schematic example of a user interface is shown in FIGS. 10 to 12. FIG. 10 shows a main screen 800. The main screen 800 comprises: a "play" object 802, with which a user can interact to begin or resume the execution of data objects according to the method described above; a "restart" object 804, with which a user can interact to cause a currently running method to stop and begin anew, optionally with new randomly-generated parameters using the techniques described above; a "stop" object 806, with which a user can interact to cause the method to stop; and a "settings" object 808, with which a user can interact to view a settings screen 900.

The settings screen 900 is shown in FIG. 11 and comprises: a "back" object 902, with which a user can interact to return to the main screen 800; one or more "settings choice" objects 904, with which a user can interact to view a settings choice screen 1000; and a "tempo" object 906, with which a user can interact to set a tempo or time interval between execution of data objects. The tempo object 906 may comprise a slider.

A settings choice screen 1000 is shown in FIG. 12 and comprises: a "back" object 1002, with which a user can interact to return to the settings screen 900; and a "choice" object 1004, with which a user can interact to select, for example, one or more instrument sounds to be played when a data object is executed. Alternatively, the choice object 1004 may allow for the selection of a genre or any other parameter as described above.

Figure 13:
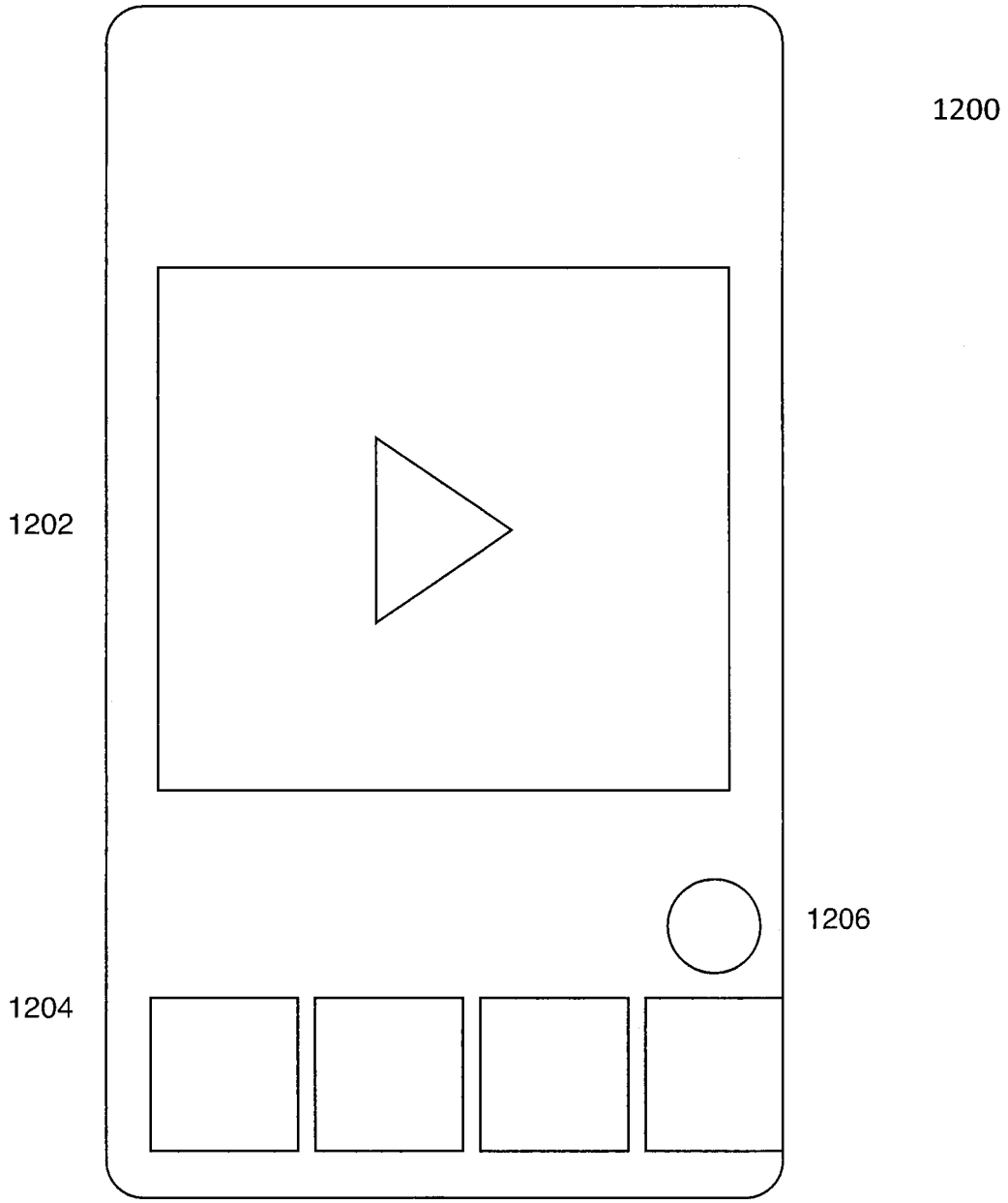
FIG. 13 shows a schematic diagram of an alternative User Interface.
Figure 14:
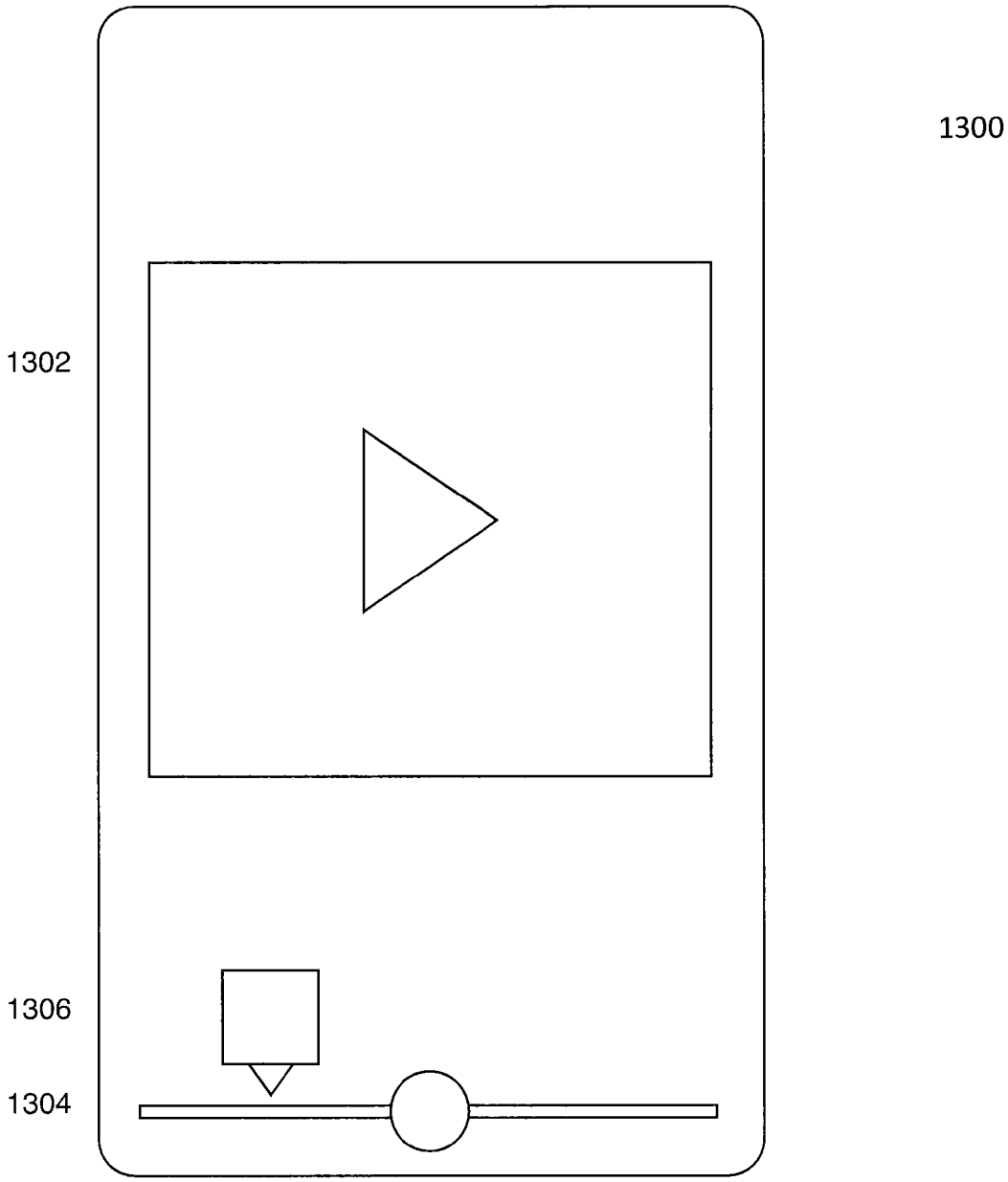
FIG. 14 shows a schematic diagram of a sync points screen.

A schematic example of an alternative user interface is shown in FIGS. 13 to 14. FIG. 13 shows a main screen 1200. The main screen 1200 comprises: a "video" object 1202, with which a user can interact to display and play a video concurrently with a list of data objects generated as described above, amounting to a soundtrack to the video; a row of "filter" objects 1204, with which a user can interact to cause the method described above to generate data objects that amount to a musical piece to accompany the video, with each "filter" selecting different generation parameters and thus allowing the user to select a different style of music; and a "sync points" object 1206, with which a user can interact to view a sync points screen 1300.

The sync points screen 1300 is shown in FIG. 14 and comprises: a "video" object 1302, with which a user can interact to display and play a video concurrently with a list of data objects generated as described above, amounting to a soundtrack to the video; a "slider" object 1304, with which a user can interact to scroll through the frames of the video and add a sync point on a particular frame, as described above; and a "sync point display" object 1306, which displays a sync point once it has been set by a user, and which a user can further interact with in order to remove or modify it.

The method may be performed on a device, and the sounds generated by the method may be stored or output on that device. Alternatively, the method may be performed on a server, and the resulting data streamed to a remote device for storage or playback. These data may be in the form of data objects, in which case the data objects are converted to audio output on the device using the audio output playing method described above; alternatively, the data may be in the form of audio data, which can be output on the device with no conversion necessary.

The method may be performed in order to generate sounds intended to accompany a video. In this case, data received from inputs may affect the parameters used to generate data objects, with the effect that the music may respond to these inputs. This input may be taken from the video automatically, such as the duration of the video or data from visual or audio analysis performed on the video; alternatively, it may be input by a user, such as the sync points described above.

The method may be performed in order to generate sounds intended to accompany events unfolding in realtime, such as a video game, a live stream or a user's day-to-day actions. In this case, too, data received from inputs may affect the parameters used to generate data objects, with the effect that the music may respond to these inputs. This input may be taken from the events automatically, such as a change of level in a video game or some form of code trigger; alternatively, it may be input by a user, such as a user pressing a button to indicate that the music should decrease its speed.

Figure 15:
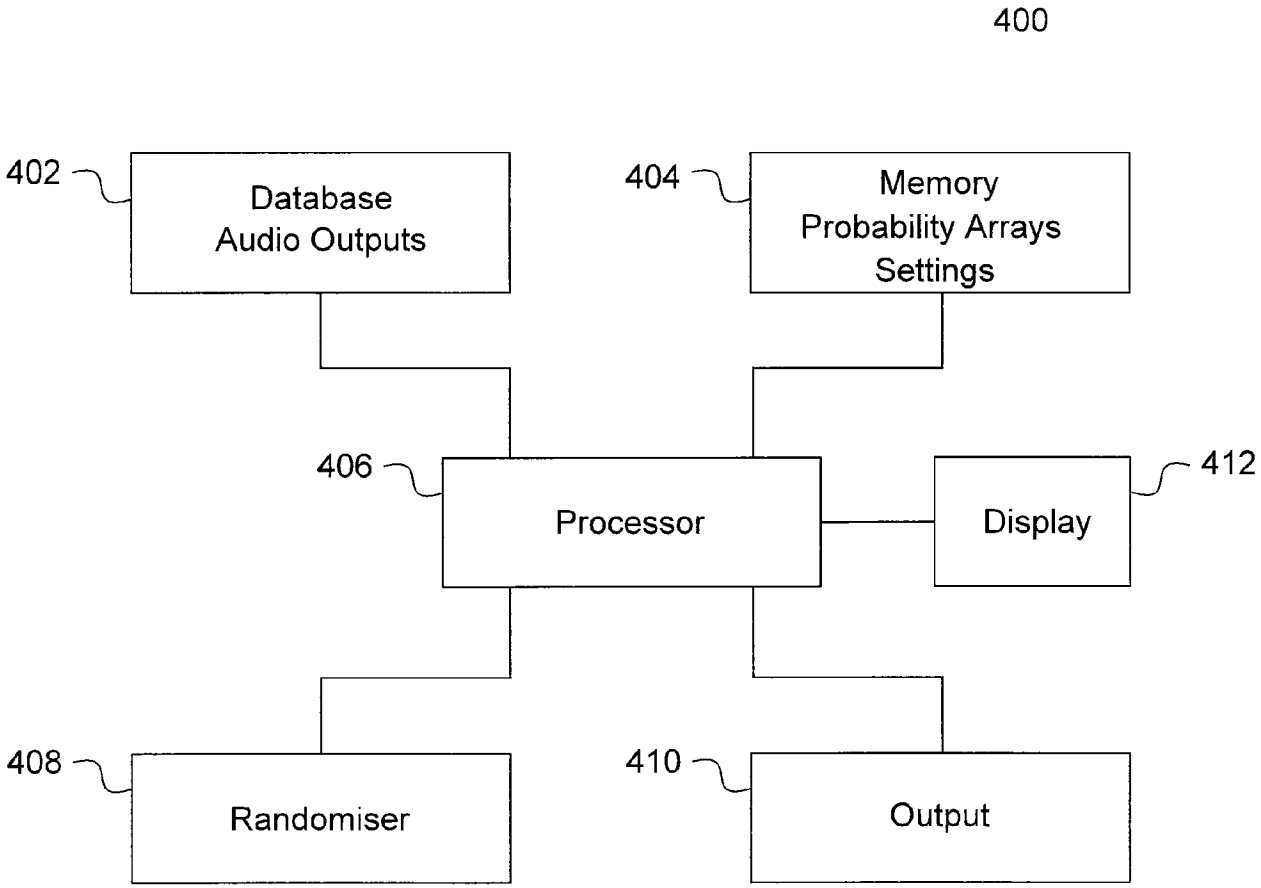
FIG. 15 is a schematic diagram of a device for performing the method disclosed herein.

It will be appreciated that the approaches described above can be performed using any appropriate algorithms and in relation to any appropriate device. The steps can be performed in software, firmware or hardware and can be implemented for example in the form of a downloadable application interacting with audio and display hardware components on a device such as a computer, laptop, tablet or telephone. Such a device 400 is shown schematically in FIG. 15. The device 400 may comprise a database 402 including audio outputs, a memory 404 including probability arrays and settings, a processor 406, a randomiser 408, an output 410 and a display 412.

The invention claimed is:

1. A method for providing one or more outputs at one or more respective time instants, the method comprising:

using a device having a processor and a memory, generating in the memory a first data object executable to provide a first portion of an output from the processor, the first data object having a parameter with a first value associated therewith;

using the device, placing the first data object in a first position in a sequence in the memory;

using the device, generating a second data object in the memory and executable to provide a second portion of the output, the second data object having a second value of the parameter;

wherein at least one of the first and second data objects represents audio data or MIDI data;

using the device, determining and setting the second value in the memory based on a probability influenced by the first value;

using the device, placing the second data object in a second position in the sequence in the memory;

using the device, executing the first data object and the second data object at the respective first and second positions in said sequence to provide said output, wherein executing the first and second data object to provide an output comprises:

playing the audio data or MIDI data, or storing the audio data for playing, or storing the MIDI data each position in said sequence representing a time instant.

2. The method of claim 1 wherein the step of determining and setting the second value further comprises determining a probability array of values of the second value, adjusting the values of the probability array based on the first value thereby providing an adjusted probability array, and setting the second value using a randomiser in the device and applied to the adjusted probability array.

3. The method of claim 1, in which said sequence comprises a list of data objects, and optionally wherein each sequential position corresponds to a beat, and further optionally wherein the data objects in the list of data objects are generated for execution at the next beat or for storage and execution at a plurality of subsequent beats.

4. The method of claim 1, wherein the second value is additionally determined according to a probability array, a pre-defined setting, a user selection, an external input, or any combination of two or more of a probability array, a pre-defined setting, a user selection, and an external input, and optionally wherein the external input is a sensor, or an accelerometer or data received from the internet.

5. The method of claim 1, wherein the parameter is anyone of a pitch, a duration, a volume, an articulation, a degree of reverberation, a timbre or a performance instrument of the audio data.

6. The method of claim 1, wherein the first and second data objects each represent at least one of a note, a chord, a rest, a mode, a percussive sound or a pre-recorded sound.

7. The method of claim 1, wherein the first and second data objects are generated according to a probability array in the memory, a pre-defined setting, a user selection, an external input, or any combination of two or more of a probability array in the memory, a pre-defined setting, a user selection, and an external input, and optionally wherein the external input is a sensor, or an accelerometer or data received from the internet.

8. The method of claim 2 further comprising the step of, before determining and setting the second value, performing a check against at least another data object scheduled either to be executed at the scheduled instant of execution of the second data object or to be executed prior to the scheduled instant of execution of the second data object, wherein the values of the probability array are also adjusted based on the check in order to provide the adjusted probability array.

9. The method of claim 8 wherein an output of the at least another data object is arranged to be ongoing at the scheduled instant of execution of the second data object.

10. The method of claim 8 wherein the at least another data object is the first data object.

11. The method of claim 8, wherein the check is a consonance check, and optionally wherein the consonance check comprises:

defining a plurality of intervals;

defining a probability for each of the plurality of intervals;

calculating an interval between the at least another data object and the second data object;

determining whether or not to schedule the second data object for execution at the scheduled instant based on the probability for the interval.

12. The method of claim 11 wherein the step of determining whether or not to schedule the second data object for execution at the scheduled instant is further based on a randomiser.

13. The method of claim 1, wherein generating the second data object further comprises:

selecting the first data object; and generating the second data object by applying a transformation to the first data object, and optionally wherein the transformation comprises a repeat, a transposition, an inversion, a retrograde, a rhythmic alteration, or any combination of two or more of a repeat, a transposition, an inversion, a retrograde, and a rhythmic alteration.

14. The method of preceding claim 1, wherein the parameter is chosen according to a probability array, a pre-defined setting, a user selection, an external input, or any combination of two or more of a probability array, a pre-defined setting, a user selection, and an external input, and optionally wherein the external input is a sensor, or an accelerometer or data received from the internet.

15. The method of claim 1, wherein the parameter is a duration of the time intervals between instants, a genre, an instrument, a key, a tonality, a number of parts, a duration of time for which the method should run, a mood, or a probability array.

16. The method of claim 1 in which generating a data object is user set or triggered by an external event or condition, and optionally wherein the external event comprises one of a user defined instant or event in visual or audio media or an automatically detected event or variation in visual or audio media.

17. The method of claim 1 wherein the device comprises any of a server, computer, laptop, tablet or telephone.

18. A device comprising:

a processor;

a memory coupled to the processor;

a non-transitory computer readable medium having computer executable instructions which when executed by the processor cause the processor to perform providing one or more outputs at one or more respective time instants by:

using the processor, generating in the memory a first data object executable to provide a first portion of an output from the processor, the first data object having a parameter with a first value associated therewith;

using the processor, placing the first data object in a first position in a sequence in the memory;

using the processor, generating a second data object in the memory and executable to provide a second portion of the output, the second data object having a second value of the parameter;

using the processor, determining and setting the second value in the memory based on a probability influenced by the first value;

using the processor, placing the second data object in a second position in the sequence in the memory; and using the processor, executing the first data object and the second data object at the respective first and second positions in said sequence to provide said output;

each position in said sequence representing a time instant.

19. The device of claim 18 comprising any of a server, computer, laptop, tablet or telephone.

20. A method for providing one or more music outputs at one or more respective beats, comprising:

using a device having a processor and a memory, generating in the memory a first audio data object executable to provide a first portion of a music output from the processor, the first audio data object having a parameter with a first value associated therewith;

using the device, placing the first audio data object in a first position in a sequence of musical notes in the memory;

using the device, generating a second audio data object in the memory and executable to provide a second portion of the music output, the second audio data object having a second value of the parameter;

using a randomiser in the device, determining and setting the second value in the memory by determining a probability array of values of the second value, adjusting the values of the probability array based on the first value thereby providing an adjusted probability array, and setting the second value using a randomiser in the device and applied to the adjusted probability array;

using the device, placing the second audio data object in a second position in the sequence of musical notes in the memory;

using the device, storing the first audio data object and the second audio data object at the respective first and second positions in said sequence to play said music output;

each position in said sequence representing a beat.

21. The method of claim 1, wherein at least one of the first and second data objections represents musical note data, and executing the first and second data object to provide an output comprises playing the musical note data or storing the musical note data for playing.

22. A method for providing one or more outputs at one or more respective time instants, the method comprising:

using a device having a processor and a memory, generating in the memory a first data object executable to provide a first portion of an output from the processor, the first data object having a parameter with a first value associated therewith;

using the device, placing the first data object in a first position in a sequence in the memory;

using the device, generating a second data object in the memory and executable to provide a second portion of the output, the second data object having a second value of the parameter;

wherein at least one of the first and second data objects represents audio data, MIDI data, or musical note data;

using the device, determining and setting the second value in the memory based on a probability influenced by the first value;

using the device, placing the second data object in a second position in the sequence in the memory;

using the device, executing the first data object and the second data object at the respective first and second positions in said sequence to provide said output, wherein executing the first and second data object to provide an output comprises playing the audio data or MIDI data, storing the audio data or MIDI data for playing, or sending the musical note data to a remote output device for playing;

each position in said sequence representing a time instant.

* * * * *